US005535500A

United States Patent [19]

Stephens et al.

[11] Patent Number: 5,535,500

[45] Date of Patent: Jul. 16, 1996

[54] METHOD FOR MANUFACTURING A BUCKET FOR A WET/DRY VACUUM CLEANER

[75] Inventors: Paul D. Stephens, Cleveland Heights; Michael F. Wright, Cuyahoga Falls; Robert A. Matousek, Lakewood; David M. Brickner, Lyndhurst, all of Ohio

[73] Assignee: Royal Appliance Mfg. Co., Cleveland, Ohio

[21] Appl. No.: 489,965

[22] Filed: Jun. 13, 1995

Related U.S. Application Data

[63] Continuation of Ser. No. 178,122, Jan. 6, 1994, abandoned.

[51] Int. Cl.[6] ..... B29C 65/06; B29C 65/58

[52] U.S. Cl. ..... 29/453; 29/527.1; 264/68; 264/328.1; 15/327.2; 15/327.6

[58] Field of Search ..... 29/453, 527.1, 29/527.3; 15/323, 325, 327.1, 327.2, 327.6, 246.4, 353; 264/68, 328.1

[56] References Cited

U.S. PATENT DOCUMENTS

| | | | |
|---|---|---|---|
| D. 263,842 | 4/1982 | Pearman, Jr. | D15/5 |
| D. 286,336 | 10/1986 | Berfield et al. | D32/23 |
| 2,656,009 | 10/1953 | Kent . | |
| 2,818,596 | 1/1958 | Martinec . | |
| 3,050,921 | 8/1962 | Seyfried . | |
| 3,149,362 | 9/1964 | Smithson . | |
| 4,218,805 | 8/1980 | Brazier | 15/321 |
| 4,222,753 | 9/1980 | Mills | 15/327.6 X |
| 4,329,756 | 5/1982 | Chicoine et al. | 15/321 |
| 4,342,131 | 8/1982 | Reid | 15/327 D |
| 4,569,100 | 2/1986 | Purkapile | 15/327.2 |
| 4,642,840 | 2/1987 | Jacob et al. | 15/323 |
| 4,654,926 | 4/1987 | McCambridge | 15/327.6 |
| 4,938,421 | 7/1990 | Berfield et al. | 239/309 |
| 5,125,129 | 6/1992 | Kasper et al. | 15/353 |
| 5,144,716 | 9/1992 | Watanabe et al. | 15/327.2 X |
| 5,150,499 | 9/1992 | Berfield | 15/327.1 |
| 5,255,768 | 10/1993 | Kasper et al. | 191/12.2 R |
| 5,283,939 | 2/1994 | Saunders et al. | 29/453 |
| 5,313,686 | 5/1994 | Berfield | 15/323 |
| 5,373,606 | 12/1994 | Bosyj et al. . | |
| 5,440,780 | 8/1995 | Rakocy et al. | 15/327.2 |

FOREIGN PATENT DOCUMENTS

| | | | |
|---|---|---|---|
| 54-15363 | 2/1979 | Japan | 15/323 |

*Primary Examiner*—S. Thomas Hughes
*Attorney, Agent, or Firm*—Fay, Sharpe, Beall, Fagan, Minnich & McKee

[57] ABSTRACT

A method for manufacturing a bucket of a wet/dry vacuum cleaner includes the step of producing a one piece conical shell with an open top end and an open bottom end. The shell is tapered such that its bottom end has a larger diameter than its top end. A base plate is also produced. Subsequently, the base plate is secured to the shell to close the shell bottom end and form a bucket. An aperture may extend through the shell and a hose inlet can be snapped to the shell through the aperture therein. A latch handle can be snapped to a latch mounting wall of the shell and a handle can be secured to the shell as well. The shell can also include an integral skirt in which are formed caster housings as well as a tool storage cavity.

26 Claims, 4 Drawing Sheets

METHOD FOR MANUFACTURING A BUCKET FOR A WET/DRY VACUUM CLEANER

This is a file-wrapper continuation of application Ser. No. 08/178,122 filed on Jan. 6, 1994, now abandoned.

BACKGROUND OF THE INVENTION

This invention relates generally to buckets. More particularly, the present invention is directed to a method for manufacturing the bucket of a wet/dry vacuum cleaner and a bucket manufactured according to the method.

While the present invention is specifically directed to buckets used in connection with wet/dry vacuum cleaners, it should be appreciated by those of average skill in the art that the method of manufacturing a bucket disclosed therein could also be utilized for manufacturing buckets useful in other environments.

Several types of vacuum cleaners employing buckets are known. The two major varieties of these are the canister-type vacuum cleaner and the wet/dry shop-type vacuum cleaner. Shop-type vacuum cleaners generally employ buckets ranging in size from 5 to 12 gallons. Generally such buckets are now made of a thermoplastic material in order to reduce both the weight and the cost of the bucket and in order to insure that the bucket does not rust. Such buckets are generally made in two parts; an upper casing portion and a lower casing portion which can include a bottom wall. These two casing portions are then secured together by conventional means.

The buckets of wet/dry type vacuum cleaners are usually mounted on casters. To this end, caster housings need to be secured to the bucket lower casing. Usually such caster housings are located radially outwardly of the casing in order to enlarge the footprint of the bucket thereby making the bucket less likely to be tipped over during use. Either a plurality of caster housings are bolted or riveted to the casing of the wet/dry vacuum cleaner or the bucket is placed on a dolly to which the caster housings are secured. Obviously, it is disadvantageous to have so many parts of the bucket which need to be separately produced and then subsequently secured to each other using fasteners. This conventional method of manufacturing buckets drives up the cost of the bucket and hence the cost of the vacuum cleaner.

Accordingly, it has been considered desirable to develop a new and improved bucket and a method of manufacturing the bucket which would overcome the foregoing difficulties and others while providing better and more advantageous overall results.

BRIEF SUMMARY OF THE INVENTION

According to one aspect of the invention, a method for manufacturing a bucket of a wet/dry vacuum cleaner is provided.

More particularly, the method comprises the steps of producing a one piece conical shell with an open top end and an open bottom end wherein the bottom end of the shell has a larger diameter than the top end of the shell. A base plate is also produced and the base plate is then secured to the shell in order to close the shell bottom and form a bucket.

Preferably, the shell and the base plate are made of a plastic material and the step of securing comprises the subsidiary step of spin welding the base plate to the shell. If desired, the step of producing the shell can comprise the subsidiary steps of forming a skirt adjacent to the shell bottom end wherein the skirt extends radially outwardly of the shell and is of one piece therewith and forming at least one caster housing in the skirt. The step of producing the base plate can comprise the subsidiary steps of forming a planar bottom wall, forming an upwardly extending skirt encircling the bottom wall and forming an annular groove in the skirt. In that case, the step of securing the base plate to the shell can comprise the subsidiary step of positioning the bottom end of the shell in the annular groove of the base plate. If desired, the step of producing the bucket can comprise the subsidiary step of forming a latch mounting wall on the shell. If desired, an aperture can extend through the shell and a hose inlet can be snapped through the opening in the shell in order to secure the hose inlet to the shell.

According to another aspect of the present invention, a bucket of a wet/dry vacuum cleaner is provided.

More particularly in accordance with this aspect of the invention, the bucket comprises a one piece conical plastic shell wherein a bottom end of the shell has a larger diameter than a top end of the shell. A latch mounting wall extends axially away from the top end of the shell with the latch mounting wall being of one piece with the shell. A base plate is secured to the shell bottom end to close the bottom end and form a bucket. A latch handle is pivotally secured to the latch mounting wall.

If desired, the shell can further comprise an annular skirt extending radially outwardly of the shell adjacent the shell bottom end. Preferably, the skirt extends past the bucket bottom end. The skirt can comprise at least one caster housing formed of one piece with the skirt. In addition, the skirt can comprise a tool housing portion. The bucket can further comprise a handle secured to the shell adjacent the top end thereof. In addition, the shell can further comprise an aperture extending through the shell and a hose inlet can be snapped to the shell through the opening therein.

One advantage of the present invention is the provision of a new and improved method for manufacturing a bucket.

Another advantage of the present invention is the provision of a new and improved tip resistant bucket for a wet/dry vacuum cleaner.

Still another advantage of the present invention is the provision of a bucket which is made of only two pieces, a conical shell and a base plate, which are secured together. If the shell and base plate are made of a suitable plastic material, these members can be secured together by spin welding.

Yet another advantage of the present invention is the provision of a bucket which has a tapered profile such that the bucket has a larger diameter adjacent its bottom end than it does adjacent its top end. Because the bucket is wider at its base than at its top, it is tip resistant. A tapered shell for such a bucket can be made from a plastic material by injection molding.

Yet still another advantage of the present invention is the provision of a bucket comprising a shell which has a latch mounting wall extending axially away from a top end thereof, into which a latch handle can be snapped. Preferably, the latch mounting wall is of one piece with the shell such that it is formed when the shell is manufactured, as by injection molding.

A further advantage of the present invention is the provision of a shell for a bucket in which the shell has an aperture extending therethrough to which a hose inlet can be snapped.

A still further advantage of the present invention is the provision of a shell for a bucket in which the shell is formed integrally with a receptacle for tool caddy.

A yet further advantage of the present invention is the provision of a bucket shell which has an annular skirt extending radially outwardly of the shell adjacent the shell bottom end and integral with the shell. The skirt can extend past a shell lower end. The skirt can comprise at least one caster housing formed of one piece with the skirt.

Still other advantages and benefits of the present invention will become apparent to those skilled in the art upon a reading and understanding of the following detailed specification.

BRIEF DESCRIPTION OF THE DRAWINGS

The invention may take physical form in certain parts and arrangements of parts a preferred embodiment of which will be described in detail herein and illustrated in the accompanying drawings which form a part hereof and wherein.

DETAILED DESCRIPTION OF THE PREFERRED EMBODIMENT

Figure 4:
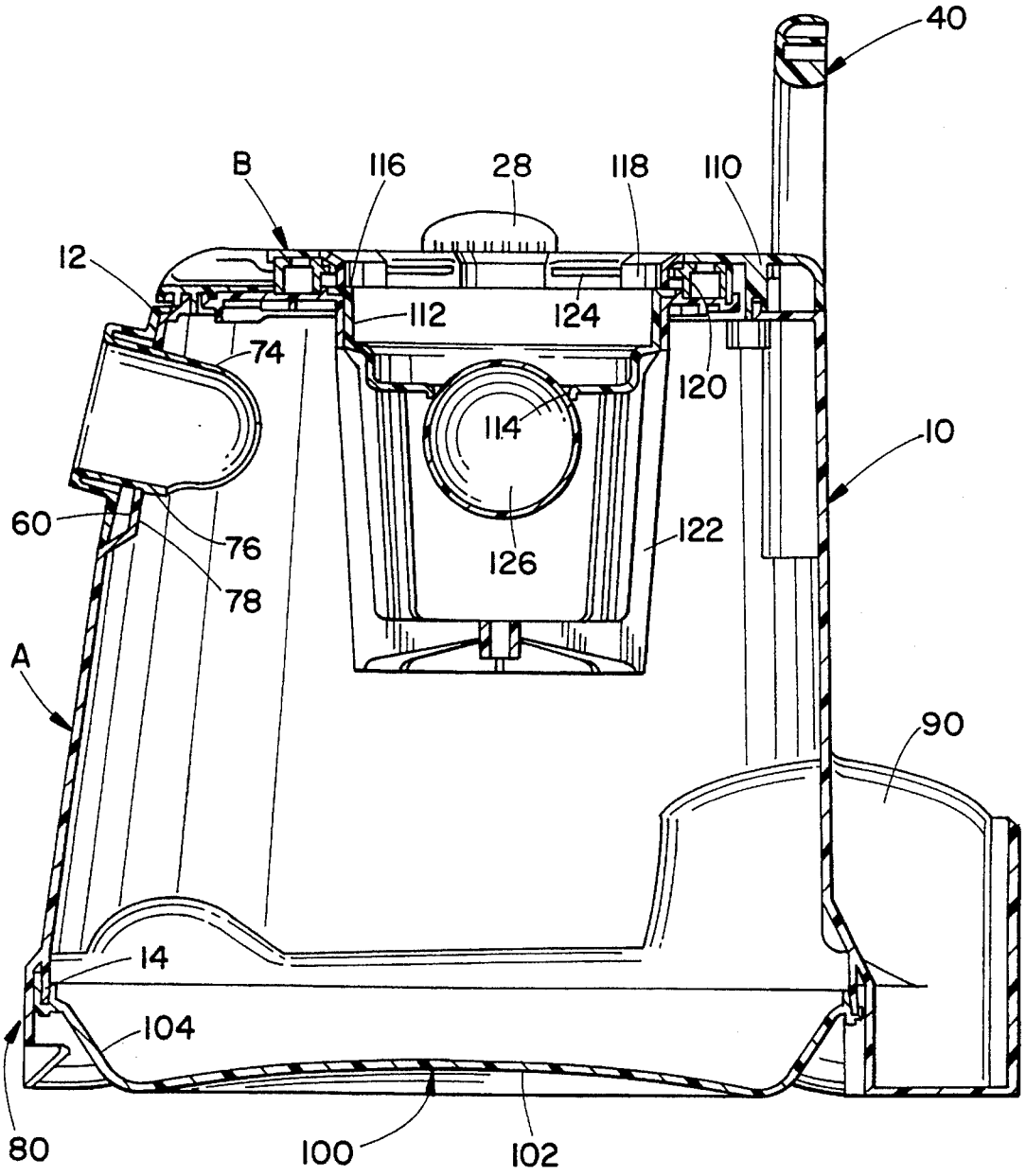

Referring now to the drawings wherein the showings are for purposes of illustrating a preferred embodiment of the invention only and not for purposes of limiting same, FIG. 4 shows a bucket A of a wet/dry type vacuum cleaner as closed by a lid B. The lid B is adapted to have a suitable blower (not illustrated herein for the sake of simplicity) selectively secured thereto. While the bucket is illustrated as being used in connection with a wet/dry vacuum cleaner, it is evident that the bucket could also be adapted for use in many other environments.

Figure 1:
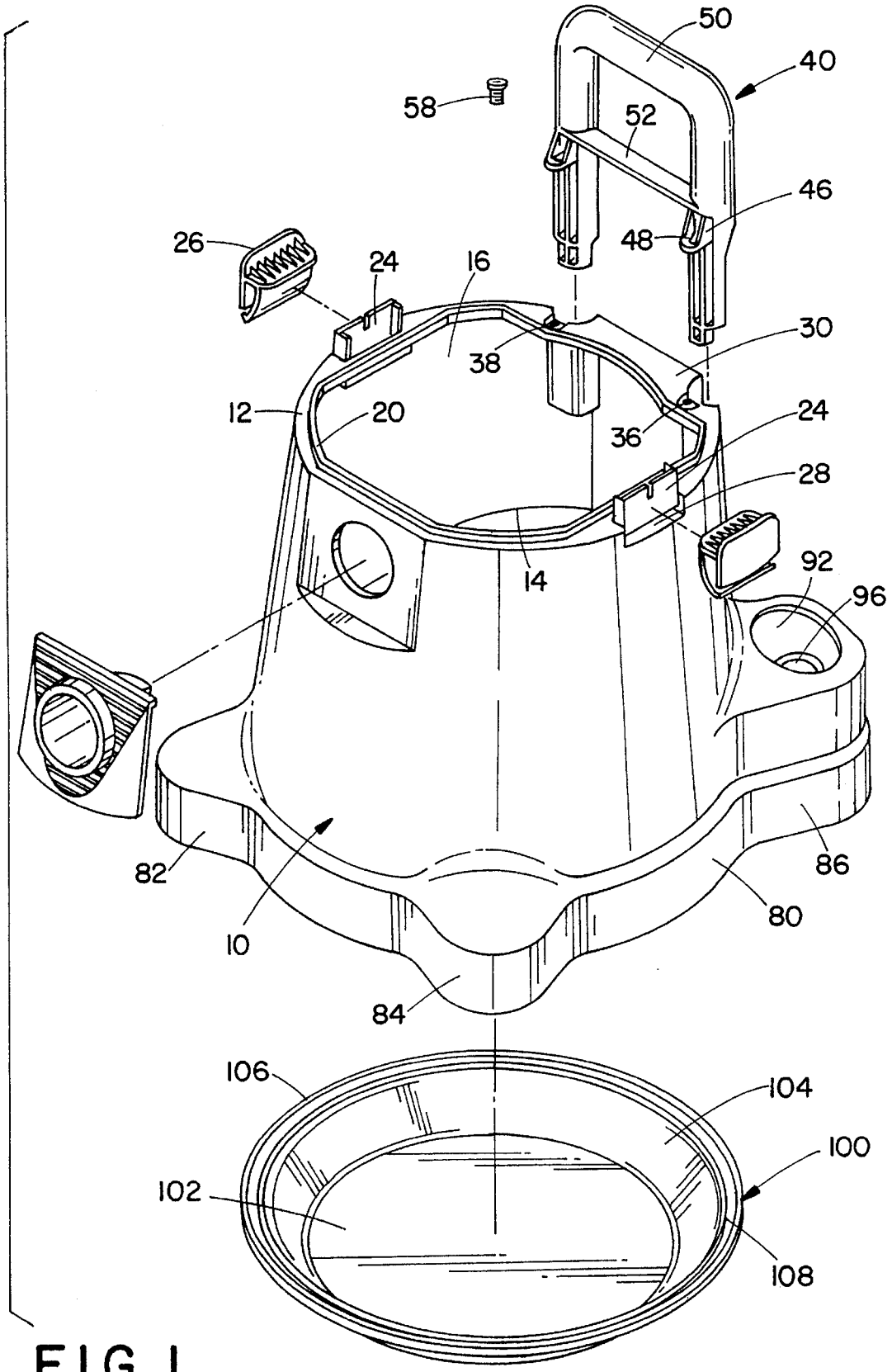
FIG. 1 is an exploded perspective view from a front right position of a bucket according to the present invention.

With reference now to FIG. 1, the bucket comprises a shell 10 having an open top end 12 and an open bottom end 14 which between them define a hollow interior 16. With reference again to FIG. 2, a reduced diameter flange 20 extends away from the top end 12. A recess 22 is defined along the top end 12 radially outwardly of the flange 20. As is evident from FIG. 2, two such recesses 22 are located on the periphery of the top end 12 spaced apart by 180 degrees. Each such recess accommodates a respective latch mount wall 24 which extends upwardly from the top end 12 of the shell 10. As is evident from FIG. 3 of the drawings, the latch mount wall 24 is of one piece with the shell top end 12. A latch 26 can be snapped into place on the latch mount wall 24 such that a lower end of the latch extends into a gap 28 formed between the latch mount wall and the recess. In other words, no fasteners are needed to secure the latch to the shell thereby simplifying the assembly of the bucket A.

Figure 3:
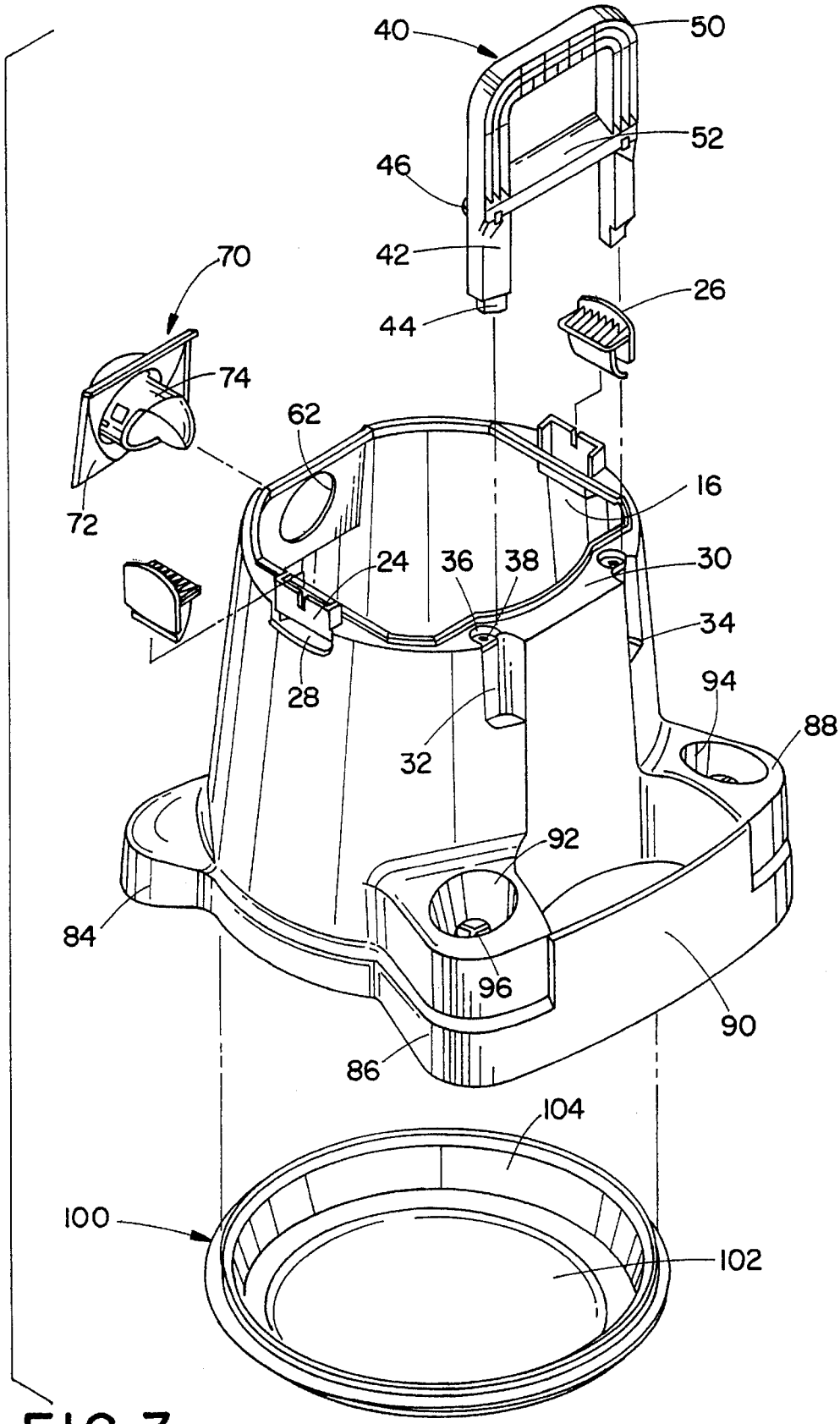
FIG. 3 is an exploded perspective view of the bucket of FIG. 1 from a rear left position; and, FIG. 4 is a cross-sectional view of the bucket of FIG. 1 with a lid secured thereon.

With continued reference to FIG. 3, the top end of the shell also includes a handle mounting portion 30 including a pair of recessed sections 32 each terminating at its lower end in a slot 34. Each of these recesses also includes an indented section 36 adjacent the shell top end 12. An aperture 38 extends transversely through the indented section 36. A handle 40 can be secured to the shell 10.

The handle includes a pair of spaced stems 42 each of which is adapted to extend into one of the recessed sections 32. A tab 44 extending from a free end of each stem is adapted to extend into the slot 34 provided in the shell 10 in order to lock the stems in place. Adjacent the upper end of each stem is a tab 46 which extends substantially normal to the handle 40. As better seen in FIG. 1, each tab has a transverse aperture 48 extending therethrough. The handles further include a grasping section 50 and a bridge 52 which stiffens the handle. The bridge is spaced from the grasping section and rests on the shell top end 12. An operator would grasp the upper end or section 50 of the handle when moving the bucket. Suitable conventional fasteners 58, such as screws, can be provided to secure the handle to the shell. The fasteners would extend through the aligned apertures 48 in the handle and 38 in the shell.

As shown in FIG. 1, the shell upper end also has an indented section 60 located approximately opposite the handle mounting portion 30. An aperture 62 extends transversely through the indented section 60. An air inlet 70 can be snapped into place on the shell. The air inlet can comprise a plate 72 which covers the indented section 60 on the shell and a tube 74 which extends transversely through the plate and hence through the aperture 62 in the shell. With reference now to FIG. 4, it can be seen that a shoulder 76 is located on the tube 74 and contacts an inner surface 78 of the indented section 60 so as to secure the air inlet 70 in place on the shell 10. Thus no fasteners are needed to secure the air inlet to the shell thereby simplifying the assembly of the bucket A.

Figure 2:
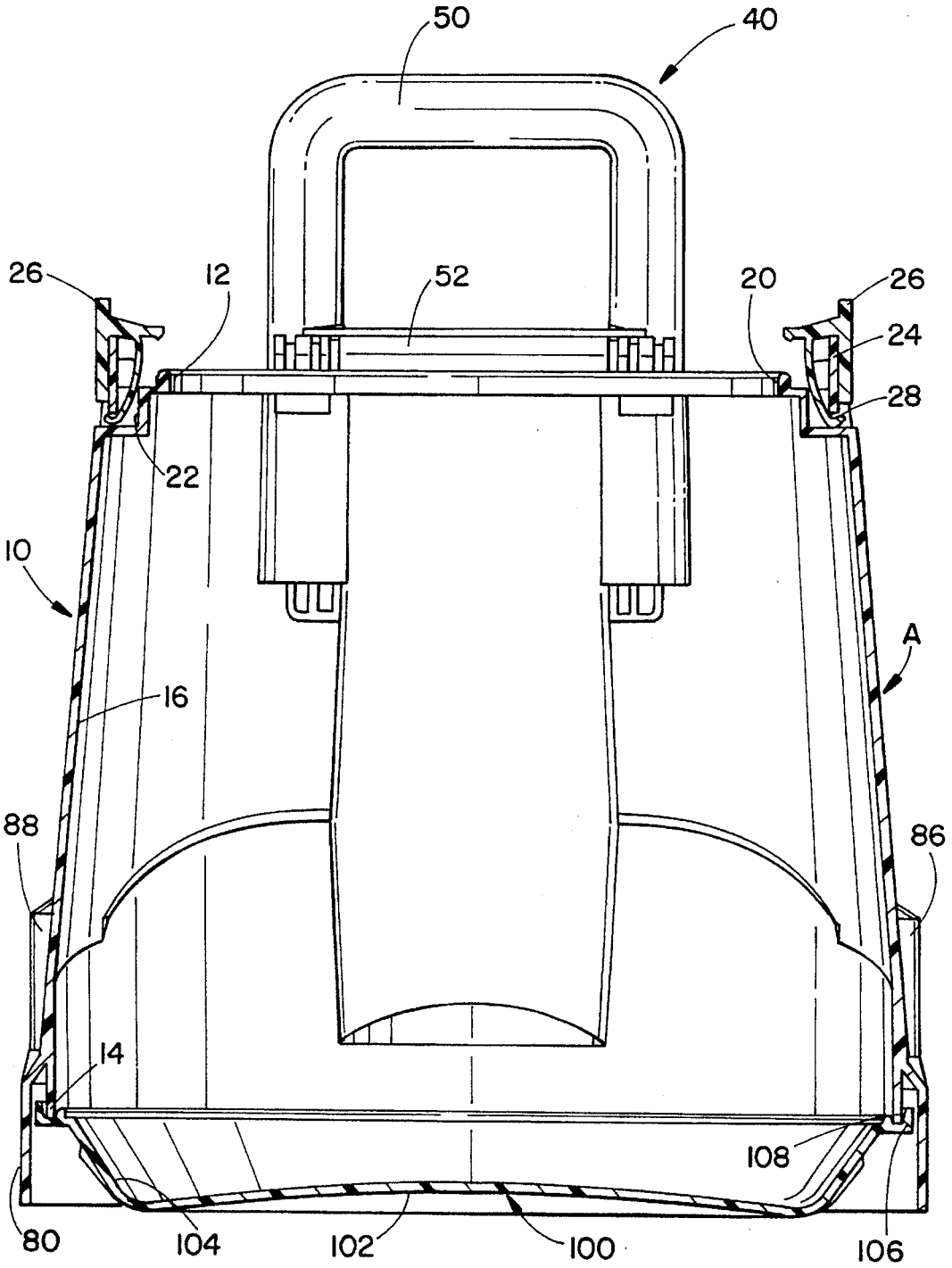
FIG. 2 is a cross-sectional view of the bucket of FIG. 1 in an assembled condition.

With reference now also to FIG. 2, the shell bottom end 14 has located adjacent thereto a peripheral skirt 80. The skirt extends radially outwardly of the shell bottom end completely around the shell. Preferably the skirt extends past the shell bottom end. Defined in the skirt are first and second spaced front caster housings 82 and 84 and first and second spaced rear caster housings 86 and 88. As best shown in FIGS. 1 and 3 the four caster housings 82, 84, 86 and 88 are located approximately 90 degrees apart around the circumference of the skirt such that one is located on each quadrant of the shell 10. Adapted to be mounted in each of these housings is a respective suitable conventional caster (not illustrated herein for the sake of simplicity).

Defined between the two rear caster housings 86 and 88 is a tool caddy housing 90 as is illustrated in FIG. 3. This housing 90 can accommodate an open-topped tool caddy (not illustrated herein for the sake of simplicity). In addition, each of the rear caster housings 86 and 88 is provided with a respective wand holding opening 92 and 94. Each of these includes an upwardly extending stub 96 onto which a wand end can be pushed as is known in the art.

Adapted to be secured to the shell bottom end 14 is a base plate 100 in order to form a bucket. The base plate comprises a bottom wall 102 which may be somewhat concave as is illustrated in FIG. 2, if desired. A peripheral skirt 104 extends upwardly and flares outwardly from the bottom wall 102. A collar 106 is formed on the radially outer periphery of the skirt 104. A groove 108 is defined in the collar 106.

With reference now to FIG. 4, the lid B can be selectively secured on the bucket A by use of the pair of latches 26 illustrated, e.g. in FIG. 3. The lid includes a lid body 110 having an indented central section 112 in which is located a substantially centrally positioned aperture 114. Surrounding the indented section is an annular surface 116 on which are defined a plurality of spaced retaining wall sections 118. A locking ring 120 is rotatably mounted between the lid 110 and a filter cage 122 which is secured to the lid. A suitable blower housing (not illustrated herein for the sake of simplicity), which supports a motor and a fan mounted to the motor, can be selectively secured on the lid such that an intake shield of the blower housing has cooperating protrusions that fit in apertures 124 defined between the retaining wall sections 118. A float 126 is mounted in the filter cage 122 to selectively shut off suction when liquid in the bucket A reaches the level of the suction intake 114 in the lid.

Injection molding of the bucket A when it is made from a suitable plastic material, such as the thermoplastic polypropylene, is preferred. Injection molding is a process by which plastic is melted and injected into a mold cavity. Once the melted plastic is in the mold, it cools to a shape that reflects the form of the cavity. The resulting form is usually a finished part requiring no additional work prior to assembly into use as a finished product. Many details, such as bosses, ribs and screw threads can be formed during a one step injection molding operation. Therefore, the skirt 80, tool housing 90, latch mount walls 24 and recesses 32 can be molded into the shell 10 as desired in a single step operation via injection molding.

However, since the bottom end 14 of the shell is larger than the top end 12, the injection mold needs to be disassembled in such a way that one mold half is withdrawn from the wider end or bottom end 14 of the shell. It is evident from FIG. 4 of the drawings that the shell 10 is an offset conical shell. Thus, the shell has a bottom end 14 with a larger diameter than its top end 12. This is in contrast to prior art buckets which are generally so configured that their top end has a larger diameter than their bottom end, thereby allowing the bottom end to be integrally molded with the bucket as the one mold half would then be withdrawn through the wider top end of the bucket. Thus the base plate 100 needs to be separately attached to the shell bottom end in order to close the shell and manufacture the bucket A.

The injection molding of an offset conical shell 10 in which the shell upper end 12 has a smaller diameter than the shell lower end 14 and in which the shell is provided with an integral skirt 80 having formed therein a plurality of caster housings 82, 84, 86 and 88 along with a tool caddy housing 90 and wand housings 92 and 94, makes it necessary that the shell be closed from the bottom with the base plate 100.

Preferably, the shell and the base plate are formed from a suitable thermoplastic material, such as polypropylene, by injection molding. Thereafter, the base plate 100 can be secured to the shell 10 by spin welding. Preferably, the shell and the base plate are formed from the same thermoplastic material as this aids the spin welding process. Spin welding is a method by which two mating parts, which can be cylindrical in shape, are assembled via natural heat created by friction. While one of the two members, in this case the shell, is held stationary in a nest fixture, the mating member, in this case the base plate, is spun rapidly against it. This action creates and magnifies the substrate temperature of the two parts and brings them to their material melt point. At this melt point moment, the spinning action is stopped and the parts are maintained under a set pressure for typically 0.2 to 0.5 seconds for cooling. Once the complete weld sequence is finished, the assembled piece is removed and the weld joint cures to its inherent temperature. This will yield a weld that is, in many instances, stronger than the thermoplastic material of the parts themselves.

There are two primary advantages with spin welding. The first is that spin welding is environmentally advantageous in relation to solvent bonding since no solvent is released to the environment so as to harm either the environment or the operator handling this manufacturing step. Large parts, such as the base plate 100 and the shell 10 disclosed herein can be spun under desired RPM and torque conditions in a more efficient and safer operation.

Another advantage of spin welding is its ability to achieve a full hermetic seal. With spin welding, the thermoplastic materials melt and molten flow around the circumference of the collar groove 108 in the base plate 100 completely seals and unifies the shell 10 with the base plate.

It is evident that a tongue and groove joint is incorporated between the shell bottom end and the base plate. While a burn mark or a ring may be formed from the heat generated thus causing discoloration of the base plate at the collar 106, this is hidden by the use of the skirt 80 which extends over this joint.

Typical in spin welding operations is the use of a random spin stop cycle. In this method, upon activation of the welding cycle, one part, in this case the base plate 100, accelerates up to its set RPM and is joined to its fixed mate, i.e. the shell 10. When the cycle concludes and the brake is applied, the orientation of these two elements is random. Such random orientation is acceptable since the illustrated spun base plate 100 is completely symmetrical. However, spin welding machines which stop at a preselected point are also known in case a base plate is not completely symmetrical and has, for example, a drain opening in it which opening needs to be oriented in relation to, e.g., a cutout in the skirt of the shell.

A number of commercial manufacturers of spin welding equipment are known.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

We claim:

1. A method for manufacturing a bucket of a wet-dry vacuum cleaner, comprising the steps of:

producing a one piece shell with an open top end and an open bottom end;

forming a tool caddy housing on the shell, wherein the tool caddy housing is of one piece with the shell;

forming a caster housing on the shell wherein the caster housing is of one piece with said shell, said caster housing being located adjacent said tool caddy housing;

producing a base plate; and, securing said base plate to said shell to close said shell bottom and form a bucket.

2. The method of claim 1 wherein said shell and said base plate comprise a plastic material and wherein said step of securing comprises the subsidiary step of spin welding said base plate to said shell.

3. The method of claim 1 wherein said step of producing said shell comprises the subsidiary steps of;

forming a skirt adjacent the shell bottom end, wherein said skirt extends radially outwardly of said shell and is of one piece with said shell; and, forming at least one caster housing in said skirt.

4. The method of claim 1 wherein said step of producing said base plate comprises the subsidiary steps of:

forming a bottom wall;

forming an upwardly extending skirt encircling said bottom wall;

forming a collar on said skirt; and, forming an annular groove in said collar.

5. The method of claim 4 wherein said step of securing said base plate to said shell comprises the subsidiary step of positioning the bottom end of the shell in the annular groove of the base plate.

6. The method of claim 1 wherein said step of producing the bucket comprises the subsidiary step of forming a latch mounting wall on said shell and further comprising the step of snapping a latch handle to said shell latch mounting wall.

7. The method of claim 1 further comprising the step of forming a wand housing on the shell.

8. A method for manufacturing a bucket of a wet-dry vacuum cleaner, comprising the steps of:

molding a one piece conical plastic shell having an open top end and an open bottom end, wherein a plurality of caster mountings are of one piece with the shell adjacent its bottom end, and wherein said shell bottom end has a larger diameter than said shell top end;

producing a base plate; and, securing said base plate to said shell to form a bucket.

9. The method of claim 8 wherein said step of molding said shell comprises the subsidiary step of injection molding said shell.

10. The method of claim 9 wherein said step of producing said base plate comprises the subsidiary step of injection molding said base plate.

11. The method of claim 10 wherein said step of securing comprises the subsidiary step of spin welding said base plate to said shell.

12. The method of claim 8 further comprising the step of securing a handle to said shell.

13. The method of claim 8 wherein said step of producing the bucket comprises the subsidiary step of forming a latch mounting wall on said shell and further comprising the step of snapping a latch handle to said shell latch mounting wall.

14. The method of claim 8 further comprising the steps of:

providing an aperture extending through said shell; and, snapping a hose inlet to said shell through said aperture in said shell.

15. A method for manufacturing a bucket of a wet-dry vacuum cleaner, comprising the steps of:

molding a one piece conical plastic shell, wherein a bottom end of said shell has a larger diameter than a top end of said shell, said shell having a plurality of spaced caster housings located adjacent its bottom end and a latch mounting wall extending away from its top end, said caster housings and said latch mounting wall being of one piece with the shell;

producing a base plate; and, securing said base plate to said shell to form a bucket.

16. The method of claim 15 wherein said step of molding said shell comprises the subsidiary step of injection molding said shell and wherein said step of producing said base plate comprises the subsidiary step of injection molding said base plate.

17. The method of claim 16 wherein said step of securing comprises the subsidiary step of spin welding said base plate to said shell.

18. The method of claim 15 wherein said latch mounting wall extends axially away from the top end of the shell and further comprising the step of snapping a latch handle to the latch mounting wall of said shell.

19. The method of claim 15 further comprising the steps of:

providing a handle; and, securing said handle to said shell.

20. The method of claim 15 further comprising the steps of:

providing an aperture extending through said shell; and, snapping a hose inlet to said shell through said opening in said shell.

21. A method for manufacturing a bucket of a vacuum cleaner comprising the steps of:

producing a one piece shell with an open top end and an open bottom end;

forming a skirt adjacent the shell bottom end wherein the skirt extends radially outwardly of the shell and is of one piece with the shell;

forming a caster housing on one of the shell bottom end and the skirt wherein the caster housing is of one piece with said one of the shell bottom end and the skirt;

producing a base plate; and, securing the base plate to the shell to close the shell bottom end and form a bucket.

22. The method of claim 21 further comprising the steps of:

forming a handle; and, securing the handle to the shell.

23. The method of claim 21 wherein said step of producing said base plate comprises the subsidiary steps of:

forming a bottom wall;

forming an upwardly extending skirt encircling said bottom wall;

forming a collar on said skirt; and, forming an annular groove in said collar wherein a bottom rim of said shell is housed in said base plate collar during said step of securing said base plate to said shell.

24. The method of claim 21 further comprising the steps of:

forming a latch mounting wall on said shell; and, snapping a latch handle to said shell latch mounting wall.

25. The method of claim 21 further comprising the step of forming a wand housing on the shell.

26. The method of claim 21 further comprising the step of forming a tool caddy housing on the shell.

* * * * *